US009121215B2

(12) United States Patent
Raynal

(10) Patent No.: US 9,121,215 B2
(45) Date of Patent: Sep. 1, 2015

(54) SYSTEM FOR SUPERVISING ACCESS TO RESTRICTED AREA, AND METHOD FOR CONTROLLING SUCH A SYSTEM

(75) Inventor: Christophe Raynal, Bretigny sur Orge Cedex (FR)

(73) Assignee: THALES, Neuilly sur Seine (FR)

( * ) Notice: Subject to any disclaimer, the term of this patent is extended or adjusted under 35 U.S.C. 154(b) by 0 days.

(21) Appl. No.: 14/124,369

(22) PCT Filed: Jun. 5, 2012

(86) PCT No.: PCT/EP2012/060574

§ 371 (c)(1),
(2), (4) Date: Dec. 6, 2013

(87) PCT Pub. No.: WO2012/168223

PCT Pub. Date: Dec. 13, 2012

(65) Prior Publication Data

US 2014/0115965 A1 May 1, 2014

(30) Foreign Application Priority Data

Jun. 9, 2011 (FR) ..... 11 01768

(51) Int. Cl.
*E05F 15/20* (2006.01)
*G07C 9/00* (2006.01)
(Continued)

(52) U.S. Cl.
CPC ..... *E05F 15/2046* (2013.01); *E05F 15/40* (2015.01); *E05F 15/70* (2015.01);
(Continued)

(58) Field of Classification Search
CPC ..... E05G 5/003; E05G 5/02
USPC ..... 49/42, 43, 44, 49; 109/6–8, 64
See application file for complete search history.

(56) References Cited

U.S. PATENT DOCUMENTS 4,060,039 A * 11/1977 Lagarrigue ..... 109/3
4,063,519 A * 12/1977 Pretini ..... 109/8
(Continued)

FOREIGN PATENT DOCUMENTS

DE 202006006478 U1 8/2007
EP 0561361 A1 9/1993
(Continued)

OTHER PUBLICATIONS

International Search Report, dated Oct. 1, 2012, which issued during the prosecution of International Patent Application No. PCT/EP2012/060574.

*Primary Examiner* — Katherine Mitchell
*Assistant Examiner* — Justin Rephann
(74) *Attorney, Agent, or Firm* — Troutman Sanders LLP

(57) ABSTRACT

The invention relates to a system for supervising access to a restricted area, including at least one obstacle that is mobile between a deployed configuration, in which said obstacle extends across a passageway for the entry and/or exit to/from said restricted area, and a stowed configuration in which said obstacle is removed from said passageway. The system also includes a unit for driving the obstacle between the deployed configuration and the stowed configuration, a device for measuring the position of the obstacle, and a module for controlling the drive unit. The control module is suitable for comparing the measured position of the obstacle at at least one moment in time with a theoretical position of the obstacle at said moment in time, and to derive a rule for controlling the drive unit.

12 Claims, 3 Drawing Sheets

(51) Int. Cl.

| | |
|---|---|
| ***G07C 9/02*** | (2006.01) |
| ***E05F 15/40*** | (2015.01) |
| ***E05F 15/70*** | (2015.01) |
| ***E05F 15/76*** | (2015.01) |
| ***E05F 15/79*** | (2015.01) |
| *E05F 15/00* | (2015.01) |
| *E05F 15/611* | (2015.01) |

(52) U.S. Cl.

CPC ..... *E05F 15/76* (2015.01); *E05F 15/79* (2015.01); *G07C 9/00007* (2013.01); *G07C 9/02* (2013.01); *E05F 15/00* (2013.01); *E05F 15/611* (2015.01); *E05Y 2400/31* (2013.01); *E05Y 2400/45* (2013.01); *E05Y 2400/508* (2013.01); *E05Y 2400/812* (2013.01); *E05Y 2800/426* (2013.01)

(56) References Cited

U.S. PATENT DOCUMENTS

| | | | | | |
|---|---|---|---|---|---|
| 4,295,297 | A | * | 10/1981 | Carroll et al. | 49/42 |
| 4,472,908 | A | * | 9/1984 | Wanzl et al. | 49/25 |
| 4,481,887 | A | * | 11/1984 | Urbano | 109/3 |
| 4,586,441 | A | * | 5/1986 | Zekich | 109/8 |
| 4,627,193 | A | * | 12/1986 | Schwarz | 49/42 |
| 4,741,275 | A | * | 5/1988 | Lewiner et al. | 109/7 |
| RE33,407 | E | * | 10/1990 | Schwarz | 49/42 |
| 5,012,455 | A | * | 4/1991 | Schwarz et al. | 367/93 |
| 5,088,235 | A | * | 2/1992 | Trikilis | 49/42 |
| 5,097,454 | A | * | 3/1992 | Schwarz et al. | 367/93 |
| 5,195,448 | A | * | 3/1993 | Sims | 109/6 |
| 5,201,906 | A | * | 4/1993 | Schwarz et al. | 109/8 |
| 5,311,166 | A | * | 5/1994 | Frye | 340/541 |
| 5,542,211 | A | * | 8/1996 | Colombo | 49/42 |
| 5,694,867 | A | * | 12/1997 | Diaz-Lopez | 109/6 |
| 5,845,692 | A | * | 12/1998 | Kellem et al. | 160/118 |
| 5,878,529 | A | * | 3/1999 | Huber | 49/68 |
| 6,076,303 | A | * | 6/2000 | Orsini | 49/68 |
| 6,308,644 | B1 | * | 10/2001 | Diaz | 109/6 |
| 6,543,185 | B1 | * | 4/2003 | Borelli | 49/42 |
| 6,742,301 | B1 | * | 6/2004 | Schwarz | 49/42 |
| 7,707,951 | B1 | * | 5/2010 | Prasad | 109/30 |
| 2001/0037601 | A1 | * | 11/2001 | Zappa | 49/41 |
| 2002/0104266 | A1 | * | 8/2002 | Ranaudo | 49/334 |
| 2005/0045078 | A1 | * | 3/2005 | Chen | 109/8 |
| 2006/0218863 | A1 | * | 10/2006 | Eshel et al. | 49/49 |
| 2008/0028682 | A1 | * | 2/2008 | Casella et al. | 49/25 |
| 2008/0110093 | A1 | * | 5/2008 | Liles | 49/42 |
| 2008/0244978 | A1 | * | 10/2008 | Soyugenc | 49/42 |
| 2009/0032585 | A1 | | 2/2009 | Kocznar et al. | |
| 2009/0090063 | A1 | * | 4/2009 | Kucer et al. | 49/104 |
| 2010/0115853 | A1 | | 5/2010 | Gebhart et al. | |
| 2010/0242368 | A1 | * | 9/2010 | Yulkowski | 49/349 |
| 2011/0107673 | A1 | * | 5/2011 | Ippolito | 49/150 |
| 2011/0289856 | A1 | * | 12/2011 | Slagel | 52/1 |
| 2013/0120108 | A1 | * | 5/2013 | Kocznar et al. | 340/5.7 |
| 2013/0199094 | A1 | * | 8/2013 | Lachance et al. | 49/13 |
| 2013/0298466 | A1 | * | 11/2013 | Osann, Jr. | 49/28 |

FOREIGN PATENT DOCUMENTS

| | | | |
|---|---|---|---|
| EP | 1990777 | A2 | 11/2008 |
| EP | 1990777 | A3 | 4/2012 |

* cited by examiner

SYSTEM FOR SUPERVISING ACCESS TO RESTRICTED AREA, AND METHOD FOR CONTROLLING SUCH A SYSTEM

CROSS-REFERENCE TO RELATED APPLICATIONS

This application is the National Stage under 37 U.S.C. 371 of International Application No. PCT/EP2012/060574, filed on Jun. 5, 2012, which claims priority to French Application No. 11 01768, filed on Jun. 9, 2011. The International Application published on Dec. 12, 2012 as WO 2012/168223. All of the above applications are incorporated herein by reference in their entireties.

FIELD OF THE INVENTION

The present invention relates to a system for supervising access to a restricted area, including at least one obstacle that is mobile between a deployed configuration, in which said obstacle extends across a passageway for the entry and/or exit to/from said restricted area, and a stowed configuration, in which said obstacle is removed from said passageway, the system also having means for driving the obstacle between the deployed configuration and the stowed configuration, a device for measuring the position of the obstacle, and a module for controlling the drive means.

BACKGROUND

Such access supervision systems are known. They generally supervise access to a pedestrian area, the inside of a building, or a public transportation system, and the obstacle generally consists of a retractable bollard, a gate, or a door.

Access supervision systems must meet two competing requirements. On the one hand, they must provide an effective barrier to the entry of fraudulent users inside the restricted area, but must at the same time provide safety for users while preventing the obstacle, after stowing thereof to free the passage for an authorized user, from colliding with said user upon redeployment.

To meet this dual requirement, the known access supervision systems generally include presence sensors suitable for detecting the presence of a user in the passageway and identifying the position of the user in the passageway. The sensors are most often suitable for identifying fraudulent users who wrongly try to cross the passageway.

However, these systems are not fully satisfactory. In fact, despite the use of presence sensors, a user may not be detected when he is in the passageway, and the obstacle may therefore collide with that user during redeployment. A fraudulent user may also manage to make enough space to cross the passageway by forcing the obstacle.

SUMMARY

One aim of the invention is therefore to propose an access supervision system suitable for reinforcing user safety. Another aim is to propose an access supervision system enabling more effective fraud prevention.

To that end, the invention relates to an access supervision system of the aforementioned type, wherein the control module is suitable for comparing the measured position of the obstacle at at least one moment in time with a theoretical position of the obstacle at said moment in time, and for deriving a rule for controlling the drive means.

According to preferred examples of the invention, the access supervision system includes one or more of the following features, considered alone or according to any technically possible combination(s):

- the drive means are capable of exerting torque on the obstacle, and the deduced control rule is capable of increasing said torque when the measured position differs from the theoretical position;
- the deduced control rule is capable of immobilizing said obstacle when the measured position differs from the theoretical position;
- the drive means are electric drive means and are capable of operating at a voltage lower than 42 V;
- the drive means are capable of exerting torque on the obstacle, and the drive module is capable of deducing the control rule designed to stabilize or reduce said torque when said torque exceeds a threshold torque;
- the value of the threshold torque is different depending on whether the difference between the measured position and the theoretical position of the obstacle is positive or negative;
- the drive means include a synchronous electric motor;
- the electric motor is a brushless motor;
- the motor is adapted to be supplied with driving current for the motor and vibrating current for the motor, the vibrating current being capable of causing the motor to produce a frequency sound included between 2 kHz and 20 kHz when it is supplied with vibration current;
- the measuring device is integrated into the drive means; and
- the control module is integrated into the drive means.

The invention also relates to a method for controlling a system for supervising access as defined above, said method having the following successive steps:

- stowing the obstacle,
- beginning deployment of the obstacle,
- measuring the position of the obstacle during deployment thereof,
- detecting a difference between the measured position of the obstacle and the theoretical position of the obstacle, and
- acting on the obstacle.

According to preferred examples of the invention, the control method includes one or more of the following features, considered alone or according to any technically possible combination(s):

- the action is an immobilization of the obstacle;
- the drive means are adapted to exert a torque on the obstacle, and the action is an increase in said torque.

BRIEF DESCRIPTION OF THE DRAWINGS

Other features and advantages will appear upon reading the following description, provided solely as an example and done in reference to the appended drawings, in which.

DETAILED DESCRIPTION

Figure 1:
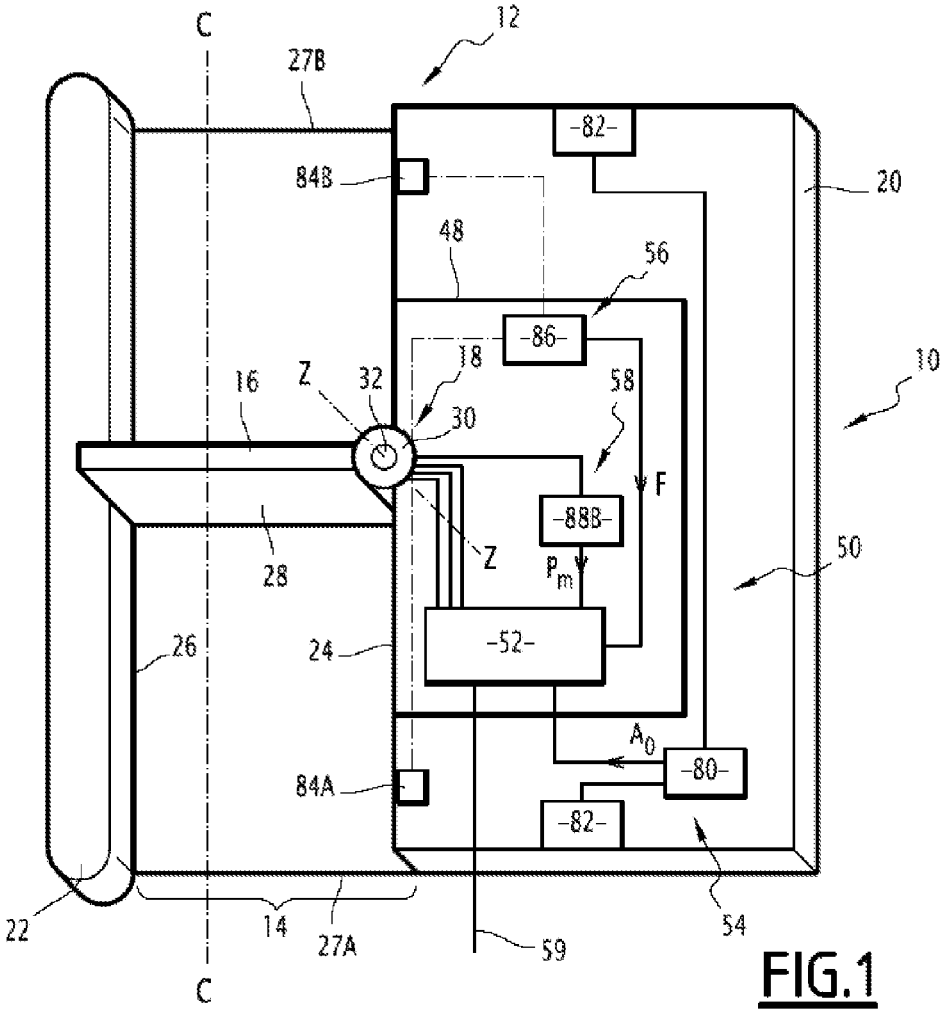
FIG. 1 is a diagrammatic top view of an access supervision system according to the invention.

The access supervision system 10, shown in FIG. 1, is a gate for supervising access to a restricted area. Said restricted area is typically a building or a public transportation system.

The access supervision system 10 includes a housing 12 defining a passageway 14, an obstacle 16, suitable for obstructing the passageway 14, and means 18 for driving the obstacle 16.

The housing 12 includes a motor compartment 20 and, optionally, a low wall 22. The motor compartment 20 defines an edge 24 of the passageway 14. The low wall 22 defines an edge 26 of the passageway 14, opposite the edge 24.

The passageway 14 constitutes an entry and exit passageway to and from the restricted area. It extends between the motor compartment 20 and the low wall 22 of said housing 12. It defines a circulation axis C to enter and exit said restricted area.

The passageway 14 emerges by an outer end 27A at the outside of the restricted area. Its opposite end 27B, here called "inner end," emerges inside the restricted area.

The obstacle 16 is mobile between a deployed configuration, in which it extends through the passageway 14, and a stowed configuration, in which it is freed from the passageway 14. In the deployed configuration, the obstacle 16 obstructs the passageway 14 and opposes crossing of the passageway 14 by a user. In the stowed configuration, the obstacle 16 frees the passageway 14 and allows crossing of the passageway 14 by a user.

In the illustrated example, the obstacle 16 is formed by a door 28. The door 28 is mounted pivotably on the motor compartment 20 around a vertical axis Z perpendicular to the circulation axis C. In the deployed configuration, the door 28 extends substantially perpendicular to the circulation axis C. In the retracted configuration, the door 28 extends substantially parallel to the axis C, along the edge 24.

Alternatively, the frame 12 includes a second motor compartment 20 replacing the low wall 22. The obstacle 16 then includes two doors 28, each door 28 being articulated around a vertical axis on a respective motor compartment 20. In the deployed configuration of the obstacle 16, each door 28 extends perpendicular to the circulation axis C. In the retracted configuration of the obstacle 16, each door 28 extends along an edge 24, 26 of the passageway 14.

The drive means 18 are suitable for driving the obstacle 16 between the deployed and stowed positions thereof. To that end, the drive means 18 are suitable for pivoting the door 28 around the vertical axis C.

The drive means 18 include a motor 30 and a device 32 for coupling the motor 30 to the obstacle 16.

The motor 30 is an electric motor, preferably synchronous, typically a brushless electric motor. It is mounted in the motor compartment 20. It is shown in FIG. 2.

Figure 2:
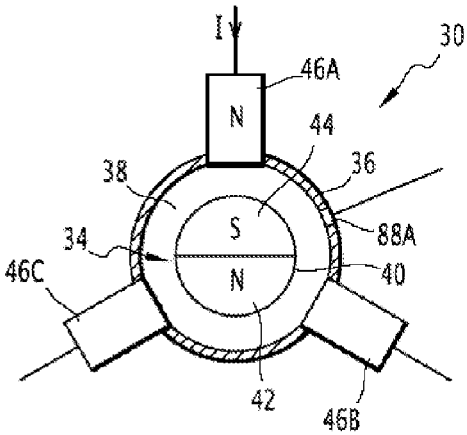
FIG. 2 is a diagrammatic cross-sectional view of a motor integrated into the access supervision system of FIG. 1.

In reference to FIG. 2, the motor 30 includes a rotor 34 and a stator 36.

The stator 36 is secured to the frame 12. It defines a substantially cylindrical cavity 38 for receiving the rotor 34.

The rotor 34 is cylindrical and extends inside the cavity 38. It is mounted rotating relative to the stator 36. To that end, ball bearings (not shown) are mounted between the rotor 34 and the stator 36 at the longitudinal ends of the rotor 34.

The rotor 34 is mechanically connected to the obstacle 16 such that it is rotatable around its axis jointly with the movement of the obstacle 16.

The rotor 34 includes at least one permanent magnet 40, preferably several permanent magnets 40, the or each permanent magnet 40 having a north magnetic pole 42 and a south magnetic pole 44. The permanent magnet 40 is made from a ferromagnetic material, typically ferrite or samarium cobalt. In the illustrated example, the rotor 34 includes a single permanent magnet 40.

The stator 36 also includes a plurality of solenoids 46A, 46B, 46C regularly distributed at the periphery of the cavity 38. In the illustrated example, there are three solenoids 46A, 46B, 46C that define sectors between them of substantially $2\pi/3$ radians along a plane perpendicular to the extension direction of the cavity 38. More generally, when the stator 36 includes a number n of solenoids 46A, 46B, 46C, the latter then delimit sectors between them measuring substantially $2\pi/n$ radians in a plane perpendicular to the extension direction of the cavity 38.

Each solenoid 46A, 46B, 46C is capable of being traveled by an electric supply current of the motor 30, so as to induce a magnetic field inside the cavity 38. Each solenoid 46A, 46B, 46C is capable of behaving like a north magnetic pole when it is traveled by the electric supply current I.

Thus, when a solenoid 46A is traveled by the supply current I, the magnetic field induced by said solenoid 46A exerts a force on the magnet 40. The magnet 40 then tends to align with the induced magnetic field. If the magnet 40 is not aligned with said magnetic field, a motor torque is exerted on the rotor 34, rotating the latter. If the magnet 40 is aligned with the induced magnetic field, then a resistive torque is exerted on the rotor 34, opposing the rotation of the rotor 34 around its axis.

When the obstacle 16 is immobile, the solenoids 46A, 46B, 46C are capable of inducing a fixed magnetic field in the cavity 38 applying a resistive torque on the rotor 34. This resistive torque opposes the rotation of the rotor 34 around its axis.

When the obstacle 16 is in motion, the solenoids 46A, 46B, 46C can induce a rotating magnetic field inside the cavity 38, so as to apply a motor torque on the rotor 34. To that end, the solenoids 46A, 46B, 46C are in turn supplied with current such that the magnet 40 is never aligned with the magnetic field induced by the solenoids 46A, 46B, 46C.

The motor 30 also includes a case 48 (FIG. 1) surrounding the rotor 34 and the stator 36. The case 48 defines the outer surface of the motor 30.

The motor and resistive torques applied on the rotor 34 are transmitted to the obstacle 16 by means of the coupling device 32.

The coupling device 32 typically includes a planetary reduction gear (not shown) capable of increasing the torque exerted by the motor 30 on the obstacle 16.

Returning to FIG. 1, the access supervision system 10 also includes means 50 for controlling the drive means 18. These control means 50 include a module 52 for supervising the electrical power supply of the motor 30, a circulation authorization system 54, a device 56 for detecting fraud, and a device 58 for measuring the position of the obstacle 16.

The circulation authorization system 54 is installed in the motor compartment 20. It includes a central unit 80 and document readers 82.

Each reader 82 is capable of communicating with a travel document belonging to a user, typically a card. Each reader 82 is for example a contactless reader and is capable of exchanging data with the travel document using a magnetic field, when the document is at a sufficient distance from the reader 82. The reader 82 is capable of transferring the exchanged data to the central unit 80.

One of the readers 82 is positioned near the outer end 27A of the passageway 14 and another reader 82 is positioned near the inner end 27B of the passageway 14.

The central unit 80 is capable of determining whether the user owning the travel document is authorized to use the passageway 14. This determination is typically made by reading a contract number on the document and verifying the accreditations granted to that contract. Other alternatives are possible and, being known by those skilled in the art, will not be described here.

The central unit 80 is capable of supervising the stowage of the obstacle 16 when the user is authorized to use the passageway 14. To that end, the central unit 80 is capable of emitting a circulation authorization notification $A_0$ to the supervising module 52.

The central unit 80 is also capable of not commanding stowage of the obstacle 16 when the user is not authorized to use the passageway 14.

The fraud detection device 56 includes presence sensors 84A, 84B, to detect the presence of a user in the passageway 14, and a computer 86.

A first presence sensor 84A is capable of detecting the presence of the user between the obstacle 16 and the outer end 27A of the passageway 14. A second sensor 84B is capable of detecting the presence of the user between the obstacle 16 and the inner end 27B of the passageway 14.

Each presence sensor 84A, 84B is capable of emitting a user detection notification to a computer 86 when the presence of a user in the passageway 14 is detected by the sensor 84A, 84B.

The computer 86 is capable of detecting a fraud attempt from user detection notifications communicated by the sensors 84A, 84B. The computer 86 is for example capable of detecting a fraud attempt when it receives a user detection notification from one of the sensors 84A, 84B whereas no circulation authorization notification has been emitted by the central unit 80, or when the sensors 84A, 84B detect the simultaneous presence of two users in the passageway 14.

The computer 86 is also capable of emitting a fraud attempt detection notification $F_0$ to the supervising module 52 when it detects a fraud attempt.

The measuring device 58 includes a sensor 88A (FIG. 2) sensing the angular position of the rotor 34 and a system 88B for detecting the position of the obstacle 16 from the angular position of the rotor 34.

The sensor 88A is secured to the stator 36 of the motor 30. It is capable of measuring the angle between the position of the rotor 34 around its axis at a moment and a reference position of the rotor 34 around its axis.

The sensor 88A is typically capable of measuring the magnetic field prevailing inside the cavity 38 to deduce the angular position of the rotor 34 therefrom. The sensor 88A is typically a Hall effect sensor.

The calculation system 88B is capable of deducing the measured position of the obstacle 16 from the angular position of the rotor 34 measured by the sensor 88A. In fact, since the rotor 34 is rotatable around its axis jointly with the movement of the obstacle 16, there is a bijective application connecting the angular position of the rotor 34 to the position of the obstacle 16 in the passageway 14. This application is implemented in the calculation system 88.

The measured position of the obstacle 16 is included between −90° and +90°. The −90° and +90° positions correspond to stowed positions of the obstacle 16. In the +90° position, the obstacle 16 extends along the edge 24 of the passageway 14, toward the outer end 27A of the passageway 14. In the −90° position, the obstacle 16 extends along the edge 24 of the passageway 14, toward the inner end 27B of the passageway 14. The 0° position corresponds to the deployed position of the obstacle 16.

The measuring device 58 is capable of transmitting the measured position $P_m$ of the obstacle 16 to the supervising module 52.

The supervising module 52 is electrically connected on the one hand to an electricity line 59, and on the other hand to the motor 30. The supervising module 52 is capable of selectively connecting each solenoid 46A, 46B, 46C of the motor 30 to the supply line 59. The supervising module 52 is thus capable of supervising the power supply of each solenoid 46A, 46B, 46C.

The supply line 59 is capable of delivering a DC driving current of the motor 30. Preferably, the delivered DC current has a voltage below 42 V, said to be very low voltage.

Figure 3:
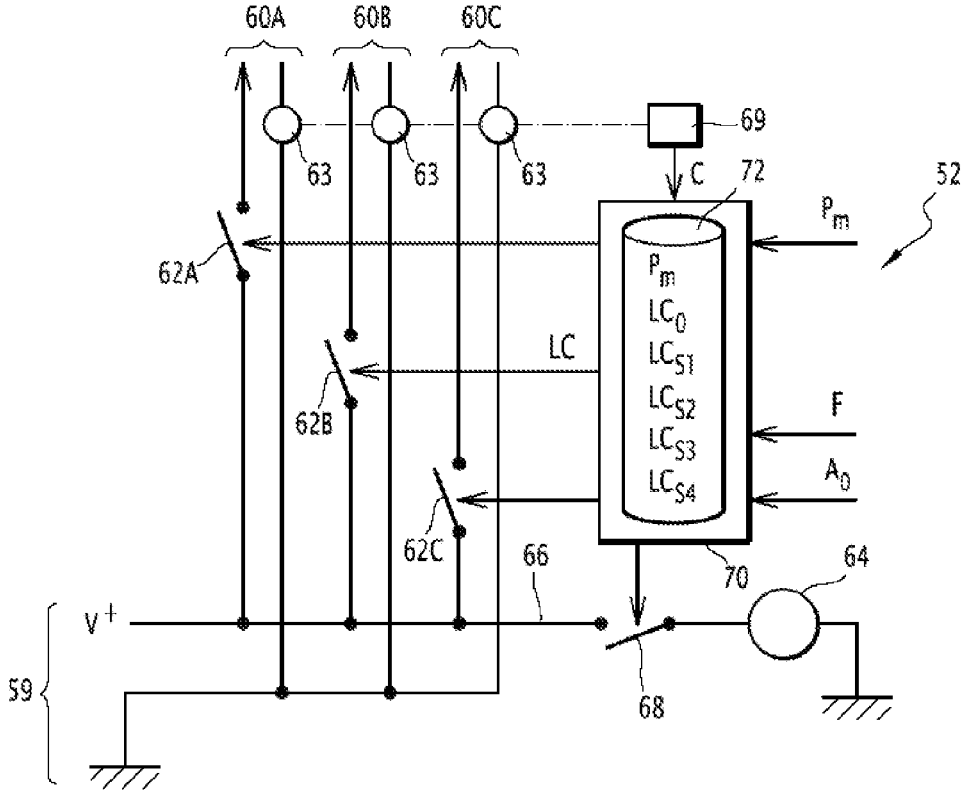
FIG. 3 is a diagram of a supervising module for the electricity of a motor integrated into the access supervision system of FIG. 1.

In reference to FIG. 3, the supervising module 52 includes a plurality of electrical lines 60A, 60B, 60C supplying the motor 30 with current. The number of electrical lines 60A, 60B, 60C is equal to the number of solenoids 46A, 46B, 46C.

Each line 60A, 60B, 60C, respectively, connects the power supply line 59 to one of the solenoids 46A, 46B, 46C, respectively. Each line 60A, 60B, 60C, respectively, is equipped with a switch 62A, 62B, 62C, respectively. Each line 60A, 60B, 60C is also equipped with a device 63 for measuring the intensity of the current circulating in the line 60A, 60B, 60C.

Each switch 62A, 62B, 62C is capable of selectively blocking the circulation of an electrical current inside the corresponding line 60A, 60B, 60C, when it is switched into a so-called off configuration, or allowing the circulation of such an electrical current when it is switched in a so-called on configuration.

Depending on the switching frequency of each switch 62A, 62B, 62C, the average supply current received by the associated solenoid 46A, 46B, 46C varies. It is thus possible to vary the intensity of the magnetic field induced by each solenoid 46A, 46B, 46C and, from there, to vary the torque exerted by the drive means 18 on the obstacle 16. It is also possible to vary the orientation of the magnetic field induced inside the cavity 38, so as to generate a rotating magnetic field inside the cavity 38 to move the obstacle 16 between its deployed and stowed positions.

The supervising module 52 also includes an AC current source 64. This source 64 is connected by electrical connecting lines 66 to each of the supply lines 60A, 60B, 60C. The line 66 is equipped with a switch 68, to selectively disconnect each solenoid 46A, 46B, 46C from the source 64 when the switch 68 is in the off configuration, or to couple each solenoid 46A, 46B, 46C to the source 64 when the switch 68 is in the on configuration.

The source 64 is capable of generating an AC current for vibrating the motor 30 such that, when injected into the solenoids 46A, 46B, 46C, said current causes the motor 30 to produce a frequency sound included between 2 kHz and 20 kHz.

The supervising module 52 also includes a device 69 for evaluating the torque C exerted by the drive means 18 on the obstacle 16, from the intensities measured by the devices 63. The manner in which this type of evaluation is done is known by those skilled in the art and will not be described here.

Lastly, the supervising module 52 includes a control module 70 for the drive means 18. This module 70 is capable of deducing, at each moment t, a control rule LC of the drive means 18 from a plurality of parameters. These parameters include:

- fraud attempt detection notifications $F_0$ emitted by the detection device 56,
- circulation authorization notifications $A_0$ emitted by the circulation authorization module 54,
- the position $P_m$ of the obstacle 16 measured by the measuring device 58 at a moment t-δt, preceding the moment t, and
- a theoretical position $P_{th}$ of the obstacle 16 at moment t-δt, stored in a memory 72 of the control module 70.

Alternatively, the control module 70 is capable of deducing the control rule LC at least at one moment.

The deduced control rule LC includes a torque reference applied by the drive means 18 on the obstacle 16 and a movement speed reference of the obstacle 16. The control module 70 is capable of controlling the switching of the switches 62A, 62B, 62C according to the control rule LC.

The control rule LC is typically a pulse width modulation (PWM) control rule.

The memory 72 also stores a default predetermined control rule $LC_0$ and a plurality of special predetermined control rules $LC_{S1}$, $LC_{S2}$, $LC_{S3}$, $LC_{S4}$.

The default predetermined control rule $LC_0$ is adapted so that, under normal operating conditions of the access supervision system 10, the actual position of the obstacle 16 corresponds to the theoretical position $P_{th}$. "Normal operating conditions" means that, with the exception of any torques due to friction of the obstacle 16 against the frame 12 or gravity, no torque other than that exerted by the drive means 18 is applied to the obstacle 16.

A first special predetermined control rule $LC_{S1}$ is adapted to immobilize the obstacle 16 irrespective of its position, without varying the value of the torque C exerted by the drive means 18 on the obstacle 16.

A second special predetermined control rule $LC_{S2}$ is adapted to increase the torque C applied by the drive means 18 on the obstacle 16 beyond that provided by the default predetermined control rule $LC_0$.

A third special predetermined control rule $LC_{S3}$ is adapted to stabilize the torque C applied by the drive means 18 on the obstacle 16.

A fourth special predetermined control rule $LC_{S4}$ is adapted to reduce the torque C applied by the drive means 18 on the obstacle 16.

Figure 4:
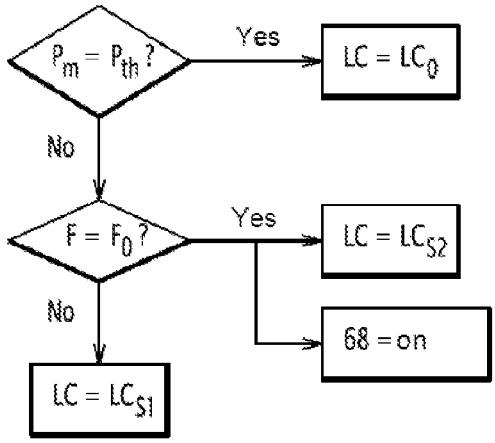
FIG. 4 is a block diagram illustrating a first method implemented by a control module of the supervising module of FIG. 4.
Figure 5:
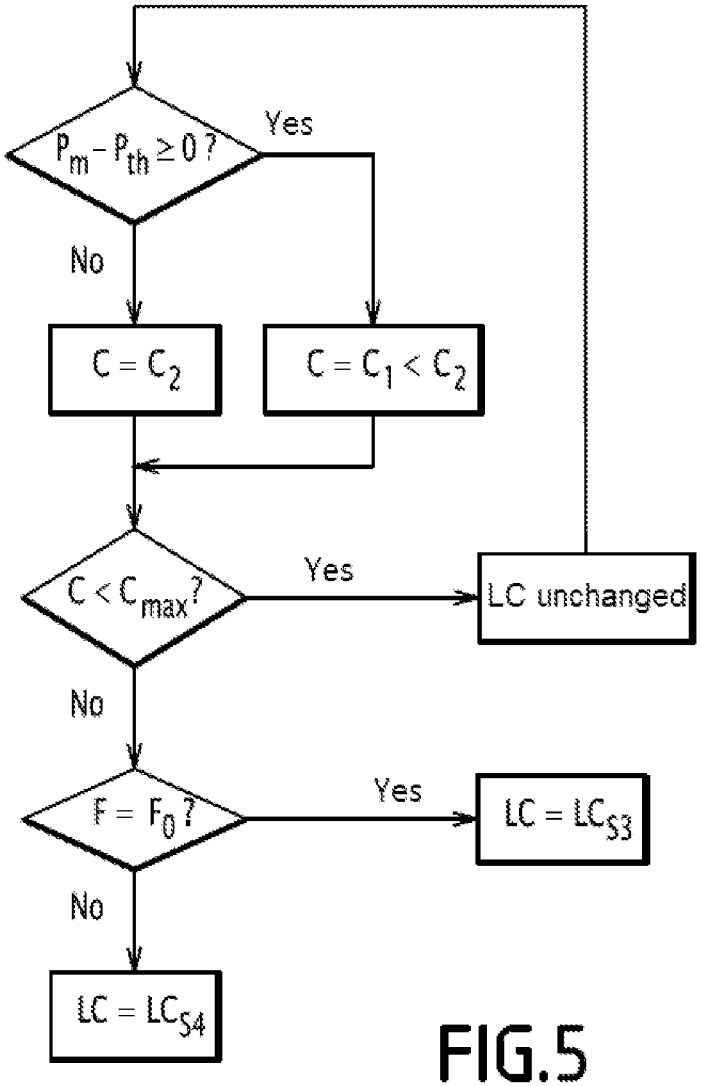
FIG. 5 is a block diagram illustrating a second method implemented by the control module of the supervising module of FIG. 4.

In reference to FIGS. 4 and 5, the control module 70 is further adapted to compare, at each moment t, the measured position $P_m$ of the obstacle 16 at a moment t-δt immediately preceding the moment t, with the theoretical position $P_{th}$ of the obstacle 16 at that moment t-δt, and to deduce the control rule LC therefrom. Thus, when the measured position $P_m$ of the obstacle 16 at moment t-δt corresponds to the theoretical position $P_{th}$ of the obstacle at moment t-δt, the module 70 is capable of deducing the control rule LC as being equal to the default predetermined control rule $LC_0$. When, however, the measured position $P_m$ of the obstacle 16 at moment t-δt differs from the theoretical position $P_{th}$ of the obstacle at moment t-δt, the module 70 is adapted to deduce the control rule LC as being equal to one of the special predetermined control rules $LC_{S1}$, $LC_{S2}$, $LC_{S3}$, $LC_{S4}$.

As shown in FIG. 4, the control module 70 is capable of deducing the control rule LC as being equal to the first special predetermined control rule $LC_{S1}$ when:

- the measured position $P_m$ of the obstacle 16 at moment t-δt differs from the theoretical position $P_{th}$ of the obstacle 16 at moment t-δt, and
- the module 70 does not receive a fraud attempt detection notification $F_0$.

The control module 70 is capable of deducing the control rule LC as being equal to the second special predetermined control rule $LC_{S2}$ when:

- the measured position $P_m$ of the obstacle 16 at moment t-δt differs from the theoretical position $P_{th}$ of the obstacle 16 at moment t-δt, and
- the module 70 receives a fraud attempt detection notification $F_0$.

As shown in FIG. 5, the control module 70 is capable of producing the control rule LC as being equal to the third special predetermined control rule $LC_{S3}$ when:

- the torque C exerted by the drive means 18 on the obstacle 16 exceeds a threshold torque $C_{max}$, and
- the module 70 receives a fraud attempt detection notification $F_0$.

The control module 70 is capable of deducing the control rule LC as being equal to the fourth special predetermined control rule $LC_{S4}$ when:

- the torque C exerted by the drive means 18 on the obstacle 16 exceeds a threshold torque $C_{max}$, and
- the module 70 does not receive a fraud attempt detection notification $F_0$.

Still in light of FIG. 5, the control module 70 is also capable of determining whether the difference between the measured $P_m$ and theoretical $P_{th}$ positions of the obstacle 16 is positive or negative. Said difference is considered to be the angle formed between the theoretical position of the obstacle 16 and the measured position of the obstacle 16, from the theoretical position toward the measured position. Thus, when the measured position $P_m$ indicates that the obstacle 16 is closer to the outer end 27A of the passageway 14 than it would be if it were in its theoretical position $P_{th}$, the difference is positive. Likewise, when the measured position $P_m$ indicates that the obstacle 16 is closer to the inner end 27B of the passageway 14 than it would be if it were in its theoretical position $P_{th}$, the difference is negative.

The control module 70 is adapted so that the value of the threshold torque $C_{max}$ is different depending on whether the difference between the measured $P_m$ and theoretical $P_{th}$ positions of the obstacle 16 is positive or negative. In particular, the control module 70 is adapted so that the value of the threshold torque $C_{max}$ is higher when the difference between the measured $P_m$ and theoretical $P_{th}$ positions is negative than when said difference is positive.

Thus, it is easier for a user to exit the restricted area by forcing the obstacle 16 than to enter said area by forcing the obstacle 16. The system 10 for supervising access thus constitutes an effective barrier against fraud, while facilitating the evacuation of users present inside the restricted area in case of emergency, for example in case of fire.

Returning to FIG. 4, the control module 70 is also adapted to switch the switch 68 into the on configuration when:

- the measured position $P_m$ of the obstacle 16 at moment t-δt differs from the theoretical position of the obstacle at moment t-δt, and
- the module 70 receives a fraud attempt detection notification $F_0$.

Thus, a fraudulent user wishing to cross the passageway 14 by forcing the obstacle 16 would trigger an alarm.

It will be noted that the supervising module 52, the measuring device 58 and the computer 86 of the detection device 56 are preferably integrated into the motor 30. They are in particular housed inside the case 48. Thus, the access supervision system 10 is easier to manufacture and the production costs of the access supervision system 10 are reduced.

A control method for the drive means 18, implemented by the control module 70, will now be described.

In the initial state, the obstacle 16 is in the deployed position. The control module 70 commands the switches 62A, 62B, 62C according to the default predetermined control rule $LC_0$, such that the drive means 18 exert a resistive torque C on the obstacle 16 keeping it immobile.

A user approaches one end 27A, 27B of the passageway 14. He shows his card to a reader 82, and the central unit 80 determines whether the user is authorized to cross the passageway 14.

The control module 70 then receives a circulation authorization notification $A_0$, emitted by the module 54. According to the default predetermined control rule $LC_0$, it commands the stowage of the obstacle 16 then, after a predetermined period of time, it commands the redeployment of the obstacle 16.

If the user approached the outer end 27A of the passageway 14, the supervising module 70 commands the drive means 18 so as to stow the obstacle 16 toward the inner end 27B. If the user approached the inner end 27B of the passageway 14, the module 70 commands the drive means 18 so as to stow the obstacle 16 toward the outer end 27A.

At the same time, the position $P_m$ of the obstacle 16 is measured using the measuring device 58. This information is sent to the control module 70 which, at each moment, compares it with the theoretical position $P_{th}$ that the obstacle 16 is supposed to occupy at that same moment.

Once the control module 70 detects a difference between the measured position $P_m$ and the theoretical position $P_{th}$, it modifies the control rule LC of the drive means 18.

At the same time, the control module 70 determines the sign of the difference between the measured $P_m$ and theoretical $P_{th}$ positions of the obstacle 16. If that difference is positive, it sets a threshold torque $C_{max}$, exerted by the drive means 18 on the obstacle 16, equal to a first value $C_1$. If the difference is negative, it sets the threshold torque $C_{max}$ equal to a second value $C_2$, greater than $C_1$.

If the detection device 56 does not emit a fraud attempt detection notification $F_0$, the control module 70 deduces the control rule LC as being equal to the first special control rule $LC_{S1}$. The control of the switches 62A, 62B, 62C is then modified so as to stop the rotation of the magnetic field within the cavity 38. The torque C applied by the drive means 18 on the obstacle 16 is kept constant.

If the detection device 56 emits a fraud attempt detection notification $F_0$, the control module 70 deduces the control rule LC as being equal to the second special control rule $LC_{S2}$. The switching frequency of the switches 62A, 62B, 62C is then increased. Furthermore, the control module 70 commands the switching of the switch 68 into the on configuration. The AC current generated by the source 64 is then injected into the solenoids 46A, 46B, 46C. Under the effect of that current, the motor 30 produces a sound with a frequency included between 2 kHz and 20 kHz.

If, however, the torque C exerted by the drive means 18 on the obstacle 16 exceeds the threshold torque $C_{max}$, then the control module 70 again modifies the control rule LC, so as to stabilize the torque C exerted by the drive means 18. Said torque C then no longer increases.

In the example described above, the access supervision system 10 has been described as having a fraud detection device. Alternatively, the access supervision system 10 does not include such a device, and the module 70 is then programmed to carry out only one of the first and second special control rules $LC_{S1}$, $LC_{S2}$, and only one of the third and fourth special control rules $LC_{S3}$, $LC_{S4}$.

Owing to the invention, the safety of the access supervision system 10 is strengthened. The obstacle 16 is in fact less likely to collide violently with the user. Furthermore, the evacuation of the restricted area in case of emergency is made easier.

Furthermore, the access supervision system 10 makes it possible to combat fraud more effectively. In fact, the increasing torque exerted by the drive means 18 on the obstacle 16 makes it possible to effectively oppose the force applied by a fraudulent user on the obstacle.

Additionally, using a brushless synchronous electric motor allows particularly easy control of the drive means.

Furthermore, the supply current of the drive means 18 is a very low-voltage current, which makes it possible to limit electrical risks for maintenance workers.

Lastly, the generation of a sound by the motor makes it possible to provide an alert that a fraud attempt is in progress.

The invention claimed is:

1. A system for supervising access to a restricted area, comprising at least one obstacle that is mobile between a deployed configuration, in which said obstacle extends across a passageway leading to or out of said restricted area, and a stowed configuration, in which said obstacle is removed from said passageway, the system also comprising:

a drive unit driving the obstacle between the deployed configuration and the stowed configuration, exerting an applied torque on the obstacle, a measuring device measuring a measured position of the obstacle, a circulation authorization system, installed in a motor compartment of the access supervision system, and comprising a central unit and document readers, each document reader communicating with a travel document of a user, and the central unit determining whether the user owning the travel document is authorized to use the passageway, and a control module controlling the drive unit, comparing the measured position of the obstacle at at least one moment in time with a theoretical position of the obstacle at said moment in time, and performing at least one of stabilizing and reducing the applied torque when the applied torque exceeds a threshold torque, wherein the value of the threshold torque is different depending on whether the difference between the measured position and the theoretical position of the obstacle is positive or negative.

2. The access supervision system according to claim 1, wherein the control module increases the applied torque when the measured position differs from the theoretical position and the applied torque is lower than the threshold torque.

3. The access supervision system according to claim 1, wherein the control module immobilizes the obstacle when the measured position differs from the theoretical position.

4. The access supervision system according to claim 1, wherein the drive unit is an electric drive unit and is capable of operating at a voltage lower than 42 V.

5. The access supervision system according to claim 1, comprising a fraud detection device.

6. The access supervision system according to claim 1, wherein the motor compartment defines an edge of the passageway.

7. The access supervision system according to claim 1, wherein the drive unit comprises a synchronous electric motor.

8. The access supervision system according to claim 7, wherein the electric motor is a brushless motor.

9. The access supervision system according to claim 7, wherein the motor is supplied with driving current for the motor and vibrating current for the motor, the vibrating current causing the motor to produce a frequency sound comprised between 2 kHz and 20 kHz when it is supplied with vibration current.

10. The access supervision system according to claim 1, wherein the measuring device is integrated into the drive unit.

11. The access supervision system according to claim 1, wherein the control module is integrated into the drive unit.

12. A method for controlling an access supervision system, said access supervision system comprising at least one obstacle that is mobile between a deployed configuration, in which said obstacle extends across a passageway leading to or out of a restricted area, and a stowed configuration, in which said obstacle is removed from said passageway, the system also comprising:

a driving unit for driving the obstacle between the deployed configuration and the stowed configuration;

a measuring device;

a circulation authorization system, installed in a motor compartment of the access supervision system, and comprising a central unit and document readers, each document reader communicating with a travel document of a user, and the central unit determining whether the user owning the travel document is authorized to use the passageway; and a control module controlling the drive unit, wherein the method comprises the following successive steps:

exerting an applied torque on the obstacle with the drive unit;

measuring with the measuring device a measured position of the obstacle at at least one moment in time;

comparing with the control module the measured position with a theoretical position of the obstacle at said moment in time;

detecting a difference between the measured position and the theoretical position;

deriving with the control module a control rule controlling the drive unit, said control rule increasing the applied torque exerted by the drive unit;

detecting that the applied torque exceeds a threshold torque; and modifying the control rule so that said control rule stabilizes or reduces the applied torque exerted by the drive unit, wherein the value of the threshold torque is different depending on whether the difference between the measured position and the theoretical position of the obstacle is positive or negative.

* * * * *